US011808004B2

(12) United States Patent
Trebil

(10) Patent No.: US 11,808,004 B2
(45) **Date of Patent: *Nov. 7, 2023**

(54) FOUNDATION PIER BRACKET SYSTEM

(71) Applicant: Jesse B. Trebil, Atwater, MN (US)

(72) Inventor: Jesse B. Trebil, Atwater, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/671,299

(22) Filed: Feb. 14, 2022

(65) Prior Publication Data

US 2022/0170224 A1 Jun. 2, 2022

Related U.S. Application Data

(63) Continuation of application No. 16/573,843, filed on Sep. 17, 2019, now Pat. No. 11,268,253.

(60) Provisional application No. 62/781,565, filed on Dec. 18, 2018, provisional application No. 62/732,974, filed on Sep. 18, 2018.

(51) Int. Cl.

| | |
|---|---|
| ***E02D 27/48*** | (2006.01) |
| ***E02D 5/22*** | (2006.01) |
| ***E02D 27/32*** | (2006.01) |

(52) U.S. Cl.

CPC ..... *E02D 5/223* (2013.01); *E02D 27/32* (2013.01)

(58) Field of Classification Search

CPC ..... E02D 5/223; E02D 27/32; E02D 35/00; E02D 27/48; E02D 35/005; E04G 25/065

See application file for complete search history.

(56) References Cited

U.S. PATENT DOCUMENTS

| | | | | |
|---|---|---|---|---|
| 4,838,737 | A * | 6/1989 | Quimby | E02D 5/60 405/230 |
| 4,866,797 | A * | 9/1989 | Vollan | E04G 25/00 52/126.6 |
| 5,246,311 | A * | 9/1993 | West | E02D 35/00 405/230 |
| 5,664,377 | A * | 9/1997 | Angelo | E02D 27/01 52/250 |
| 5,951,206 | A * | 9/1999 | Gregory | E02D 35/00 405/230 |
| 6,256,940 | B1 * | 7/2001 | MacKarvich | E04B 1/34352 52/126.6 |
| 6,659,692 | B1 * | 12/2003 | May | E02D 35/00 405/230 |
| 6,676,335 | B1 * | 1/2004 | Hickman | E02D 35/00 405/230 |

(Continued)

*Primary Examiner* — Benjamin F Fiorello

(74) *Attorney, Agent, or Firm* — Skaar Ulbrich Macari, P.A.

(57) ABSTRACT

A foundation reinforcement system may include an elongated beam, a first bracket assembly and a second bracket assembly. Each bracket assembly includes a shaft receiving portion and a seat portion. The seat portion includes a plurality of protruding members that protrude upwardly therefrom. The elongated beam is disposed atop the seat portion of the first bracket assembly such that at least one of the plurality of protruding members of the bracket assembly is disposed on each of opposing lateral sides of the elongated beam. The bracket assemblies are horizontally spaced-apart from each other. The elongated beam is disposed atop the seat portion of the second bracket assembly such that at least one of the plurality of protruding members of the second bracket assembly is disposed on each of opposing lateral sides of the elongated beam.

12 Claims, 19 Drawing Sheets

(56) References Cited

U.S. PATENT DOCUMENTS 6,820,379 B1 * 11/2004 Krinner ..... E04H 12/2223 52/366
8,480,335 B1 * 7/2013 Hunter ..... E02D 5/00 405/230
8,714,880 B1 * 5/2014 Mitchell ..... E02D 35/005 405/230
11,268,253 B2 * 3/2022 Trebil ..... E02D 5/223
2002/0076281 A1 * 6/2002 Gregory ..... E02D 35/00 405/229
2002/0176749 A1 * 11/2002 Provost ..... E02D 35/00 405/252.1
2003/0208974 A1 * 11/2003 Creed ..... E02D 5/54 405/244
2004/0091322 A1 * 5/2004 May ..... E02D 35/00 405/252.1
2006/0275085 A1 * 12/2006 Ong ..... E02D 35/00 405/230
2007/0006540 A1 * 1/2007 Linse ..... E02D 27/01 52/263
2007/0056227 A1 * 3/2007 Angelo ..... E02D 27/48 52/169.9
2007/0286684 A1 * 12/2007 Heppner ..... E02D 27/34 405/230
2014/0026496 A1 * 1/2014 Gregory ..... E02D 35/00 52/741.15
2014/0356076 A1 * 12/2014 Hale ..... E02D 5/54 405/255
2015/0152637 A1 * 6/2015 Kordecki ..... E04G 21/243 52/704
2015/0218771 A1 * 8/2015 West ..... E02D 35/00 405/231
2016/0186403 A1 * 6/2016 Tomchesson ..... E02D 5/54 405/252.1
2018/0135269 A1 * 5/2018 Reusing ..... E02D 5/223
2020/0270827 A1 * 8/2020 Newcomb ..... E01D 19/02

* cited by examiner

FOUNDATION PIER BRACKET SYSTEM

PRIORITY

This application is a continuation of U.S. patent application Ser. No. 16/573,843, filed Sep. 17, 2019, which claims the priority benefit of U.S. Provisional Application No. 62/732,974 filed on Sep. 18, 2018 and U.S. Provisional Application No. 62/781,565 filed on Dec. 18, 2018, and each of which are hereby incorporated herein by reference in their entirety.

FIELD

The present invention relates, in general, to foundation support systems and, more particularly, to a foundation pier bracket system to support or lift a building.

BACKGROUND

Structures are sometimes built on bad soil, and certain types of soils react differently to loads and moisture content. When the soil fails or shrinks, the structure can settle unevenly so that the building leans or breaks apart. The best way to fix this is to install foundation piers. These piers are a great solution because they are driven through the inadequate soil and into good load bearing strata or bedrock. The piers used on existing buildings are either helical or push piers, which are both great at holding large loads and are used in a variety of manners. The basic installation process includes digging down to the bottom of the footing. Then, the footing is notched and chiseled smooth so that it properly accepts the pier bracket, and the pier is driven to load bearing capacity and capped. When all the piers are installed, a hydraulic cylinder can be installed on each pier in a series to lift the structure to level again. Now the weight of the structure is carried by the piers, with a safety factor calculated in, and not on the poor soil.

The problem with piers used on existing structures or retrofit applications is that the load on the pier is eccentric rather than concentric. In new construction you can identify the need for piers based on the types of soil and the weight of the structure being built, install new construction helical piers first, and then build the building directly over the piers. This provides concentric loading of the piers. Unfortunately, in repair situations it is necessary to install the piers alongside of the footing, which loads the pier eccentrically. This, in turn, can create a bending moment and the pier bracket can try to slide out from under the footing. In addition, bending can occur below the bracket in the pier shaft. Another problem is the bracket can deform and fail. There are retrofit concentric piers on the market, but they are dangerous and very difficult to install.

As such, there is a need for a new and improved pier and bracket system to solve the problems inherent with current systems and methods.

SUMMARY

The present invention, in certain embodiments, addresses the drawbacks and weaknesses of the prior art by providing an open back pier bracket, which makes it easier to install on both helical and push piers without sacrificing any load bearing capacity. Due to the two-frame rail design of the present invention, weight capacity increases, thereby addressing conventional pier deformation issues. The invention also uses a reinforcing tube that transfers the bending moment lower into the ground, virtually eliminating typical pier shaft bending issues.

Further, embodiments of the bracket system can include four evenly spaced spikes pointing upwards out of the seat of the bracket. The spikes enable the bracket to bite or lock into the footing as the pier is loaded. When the bracket bites into the footing it is less likely that the bracket will slide out from under the footing. This enables users to install at higher capacities, safely, and to hold for longer periods of time. The spikes are part of the robust frame rails, so the weight of the structure is transferred directly into the frame of the bracket.

The pier bracket locks into a reinforcing sleeve, thereby stopping the bracket from lifting and falling during the installation process. This improves install speed and safety.

In addition, parts or sections of the brackets of the present invention can be cut out with a CNC plasma table, or like systems or techniques, and welded with a welder (e.g., robot welder). This design facilitates locking or mating of the components, like a puzzle, to increase reliability and strength.

The disclosure also includes a foundation pier bracket system. The system can include a reinforcing sleeve and a bracket assembly. The bracket assembly can include a shaft receiving portion and a seat portion. The shaft receiving portion can define an aperture that is sized and shaped to receive a portion of the reinforcing sleeve therein. The seat portion can include a plurality of protruding members that protrude upwardly therefrom. The seat portion can be planar. The reinforcing sleeve can extend through the seat portion in a direction perpendicular to the plane of the seat portion. The aperture can be circular. The plurality of protruding members are arranged in two rows with each row having two columns such that a beam can be restrained between the adjacent rows.

The plurality of protruding members are arranged such that they restrain lateral movement of a beam along the seat portion in at least one axis. The protruding members can be triangular and be arranged such that a single point thereof points vertically upward from the seat portion. Other shapes are disclosed below.

The reinforcing sleeve can include a locking wedge that extends longitudinally along an outer surface of the reinforcing sleeve. The locking wedge can taper towards the outer surface of the reinforcing sleeve as the locking wedge extends towards a distal end of the reinforcing sleeve. The reinforcing sleeve can include a top flange located adjacent to a proximal end of the reinforcing sleeve.

The bracket assembly can further comprise a jack support plate. The jack support plate can include a plurality of bracket jack accommodation slots defined therethrough. The system can further include a bracket jack that is engageable with the bracket assembly.

The seat portion can include a flange nut secured thereto and arranged such that a bolt threaded into the flange nut from below the seat portion can protrude through the seat portion and extend vertically above the seat portion.

The disclosure still further includes a method of providing support to a foundation of a building. The method can include placing a bracket assembly such that a seat portion thereof will engage a footing of the building, and inserting a reinforcing sleeve through a receiving portion of the bracket assembly until a locking wedge defined on the reinforcing sleeve secures the reinforcing sleeve to the bracket assembly.

A plurality of protruding members that protrude upwardly from the seat portion can be engaged with a lower surface of the footing of the building.

A support beam can be restrained between adjacent rows of protruding members that protrude upwardly from the seat portion.

A pair of bracket assemblies can be placed on laterally-opposite sides of a structural defect in the building and supporting each of the opposing ends of the support beam with a respective one of the pair of bracket assemblies.

A bolt can be threaded upwardly through a flange nut secured to the seat portion from below the seat portion such that the bolt protrudes through the seat portion and extends vertically above the seat portion.

A bracket jack can be engaged with a plurality of bracket jack accommodation slots defined through a jack support plate of the bracket assembly.

A plurality of pier sections can be pushed into the ground to raise a portion of the building via the bracket assembly engaged with the footing of the building.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

DETAILED DESCRIPTION

Figure 2:
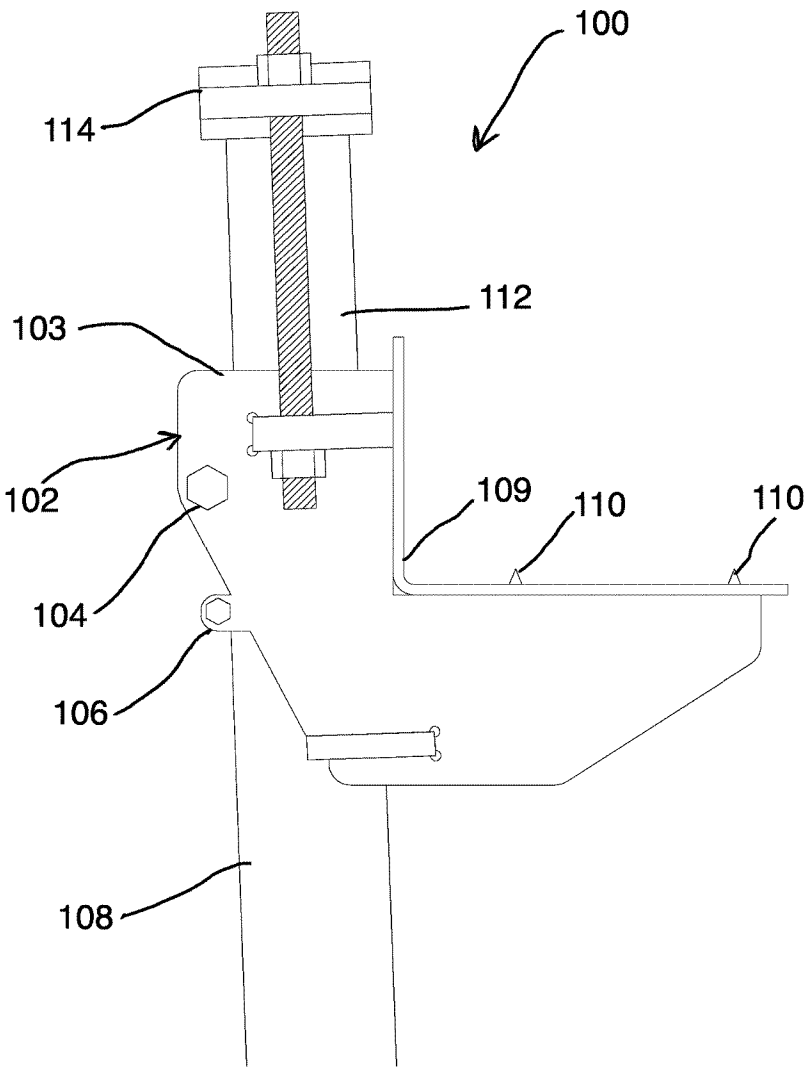
FIG. 2 is a side view of a foundation pier bracket system, in accordance with embodiments of the present invention.

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention. The invention is to cover all modifications, equivalents, and alternatives falling within the scope of the invention as defined by the appended claims.

The various features or aspects discussed herein can also be combined in additional combinations and embodiments, whether or not explicitly discussed herein, without departing from the scope of the invention.

Exemplary embodiments of a foundation pier bracket system 100 are depicted in FIGS. 1-30, wherein the system is adapted to repair or provide new construction support for residential or commercial buildings. The bracket system 100 includes bracket structures secured to the building foundation, with one or more shafts extending through the upper soil S for anchoring into strata ST or stable soil below.

Referring generally to FIGS. 1-5, the bracket system 100 can include a bracket assembly 102, a placement bolt 104, a reinforcing sleeve clamp 106, and a reinforcing sleeve 108. A shaft receiving portion 103 and a plate engagement or seat portion 109 are included. The seat portion 109 can include one or more teeth or other protruding members 110. The members 110 can include a plurality (e.g., four in certain embodiments) of evenly spaced spikes extending out from the seat 109 of the bracket 102. The spikes 110 enable the bracket 102 to bite or lock into the footing FT as the pier is loaded. When the bracket 102 bites into the footing FT of the foundation F it is less likely that the bracket 102 will slide out from under the footing FT. This enables users to install at higher capacities, safely, while holding for longer periods of time. The spikes 110 are part of the robust frame rails, with the weight of the structure transferred directly into the frame of the bracket 102.

Figure 1:
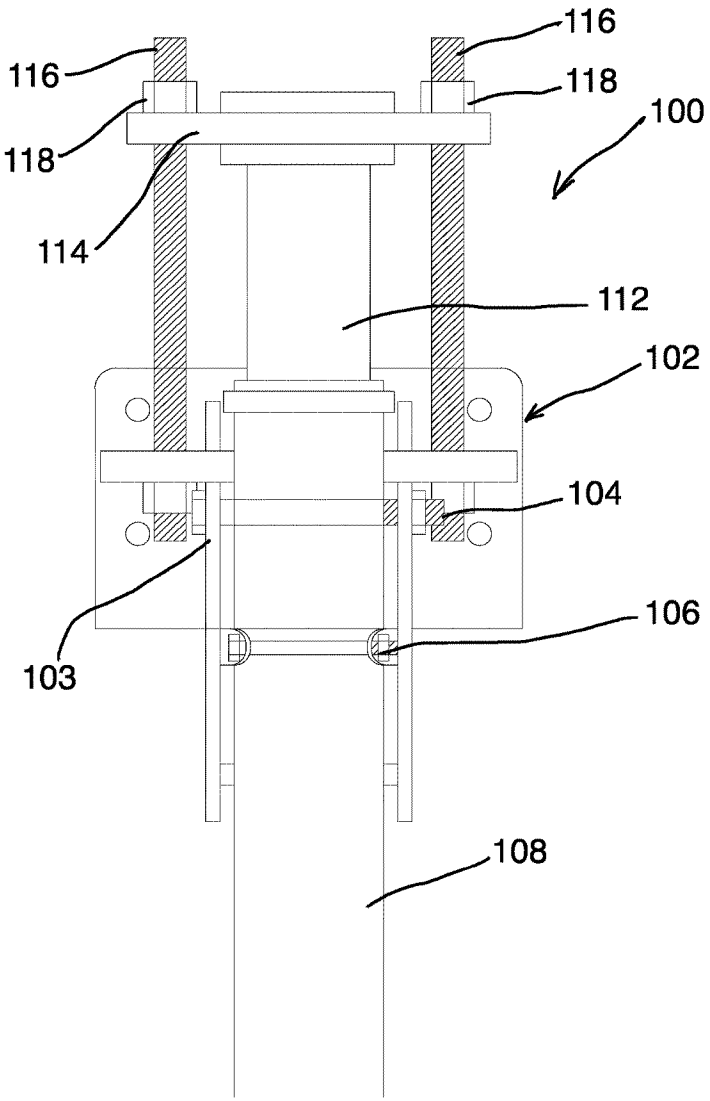
FIG. 1 is a front view of a foundation pier bracket system, in accordance with embodiments of the present invention.
Figure 4:
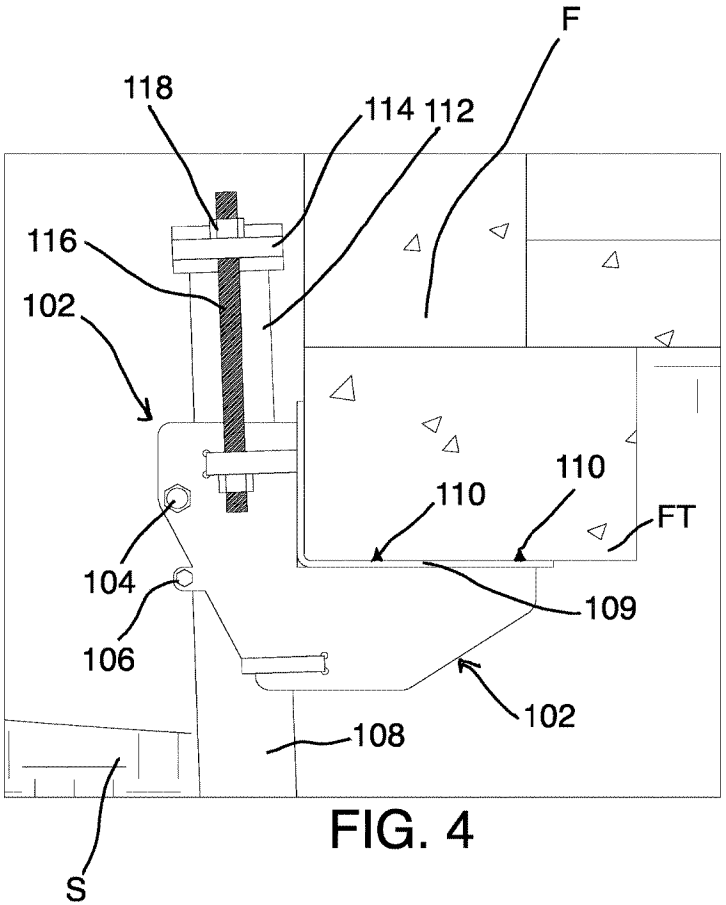
FIG. 4 is an enlarged view of a portion of FIG. 3.
Figure 3:
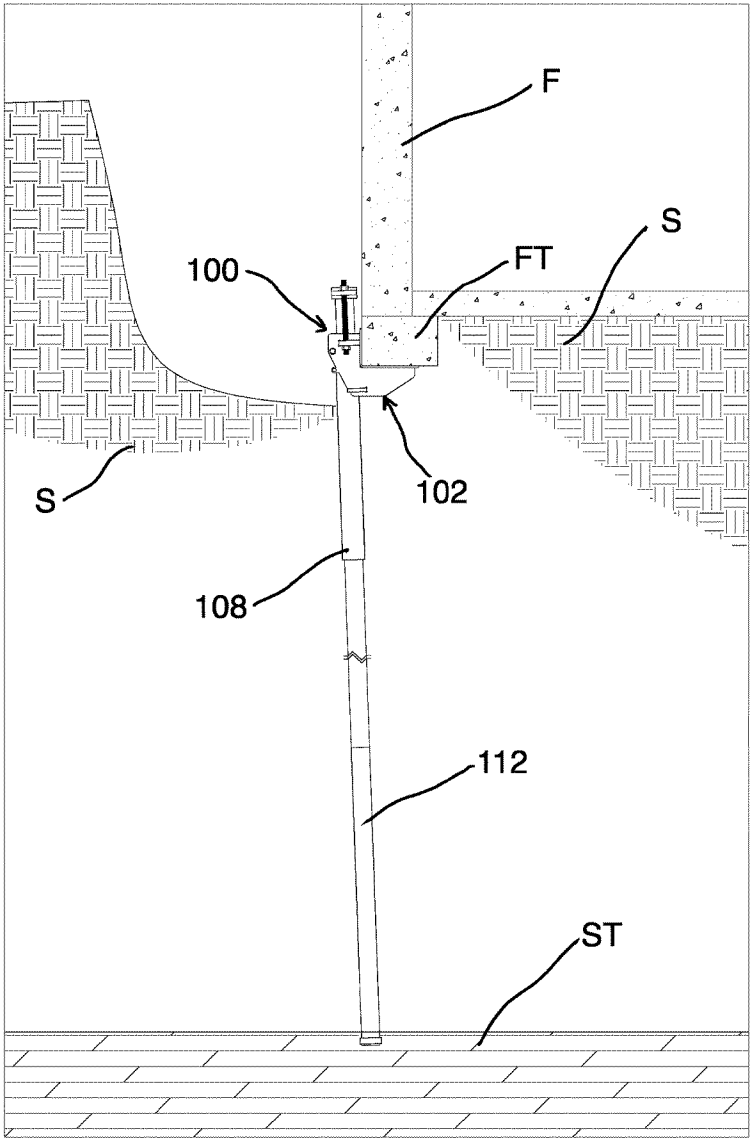
FIG. 3 shows a side cross-sectional view of a foundation pier bracket system in use to support a building structure, in accordance with embodiments of the present invention.
Figure 5:
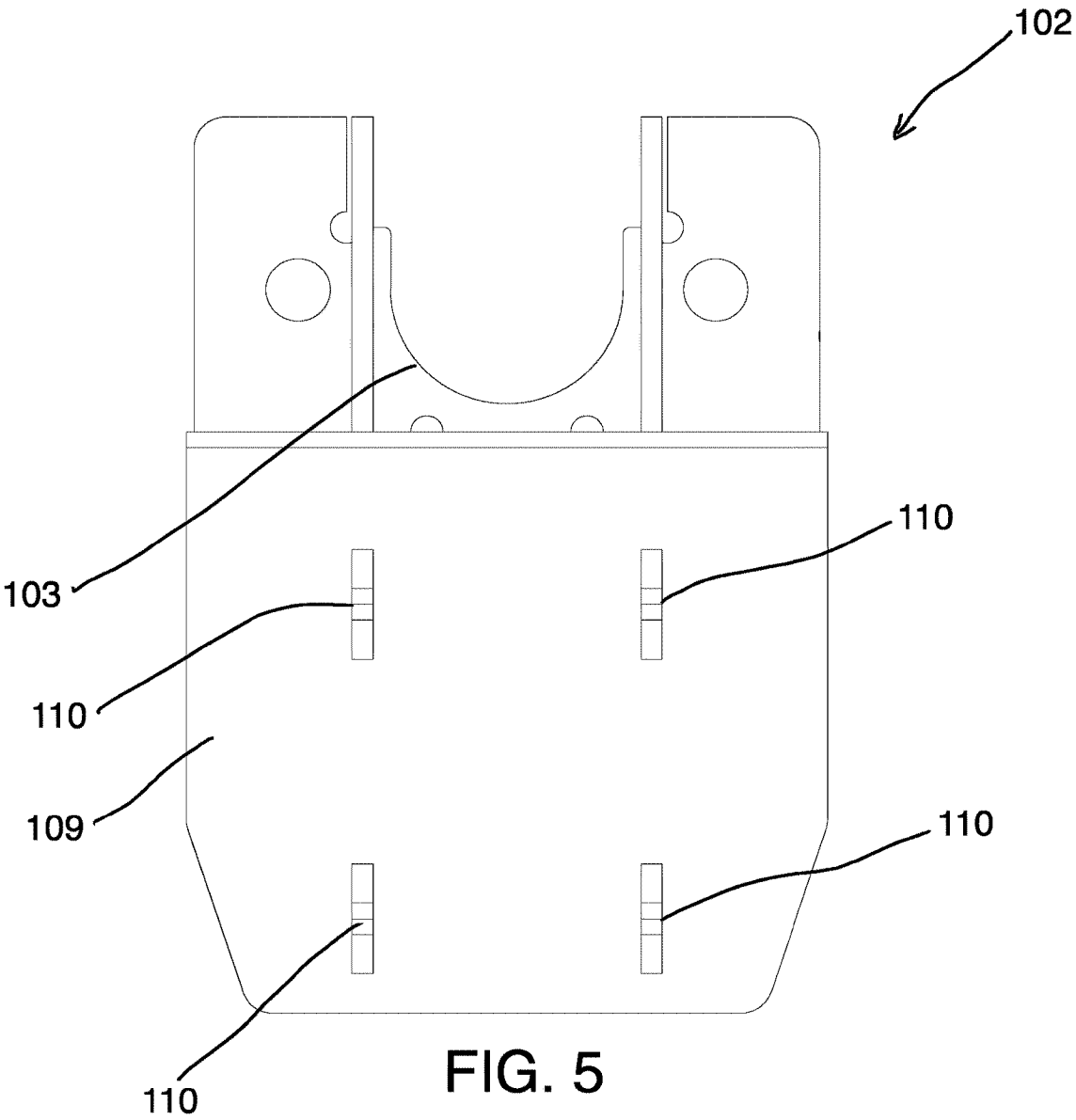
FIG. 5 is a top view of a foundation pier bracket, in accordance with embodiments of the present invention.

The bracket assembly 102 is adapted to receive and secure around a pier shaft 112. A cap 114 and one or more threaded rods 116 and nuts 118 are provided operatively attached to the bracket 102 and the pier shaft 112. FIG. 1 shows various components and elements, fixed and adjustable, configured to facilitate attachment of the bracket 102 to the building foundation. As shown in FIGS. 1-3, the bracket system 100 facilitates improved attachment of the pier shaft 112 with the foundation F, and securement down to competent bearing strata ST to provide an open back pier bracket. This construct is easy to install on both helical and push piers, without sacrificing any load bearing capacity. Due to the two-frame rail design of the present invention, weight capacity increases, thereby addressing pier deformation issues with the prior art. Further, the reinforcing sleeve or tube 108 allows for transferring of the bending moment lower into the ground, virtually eliminating pier shaft 112 bending issues.

The pier bracket locks into the reinforcing sleeve 108 to stop the bracket 102 from lifting and falling during the installation process. This also makes the install faster and safer.

In addition, parts or sections of the brackets of the present invention can be cut out with a CNC plasma table, or like systems or techniques, and welded (e.g., via a robot welder). This design facilitates locking or mating of the bracket components or portions, like a puzzle. The parts or sections lock together so that the welds are not relied on to carry the weight—the welds merely keep the structure from falling apart. Prior art brackets rely on the structure of the welds—if the welds break, the bracket fails. If the welds of the present system break, the bracket continues to function as designed.

Figure 7:
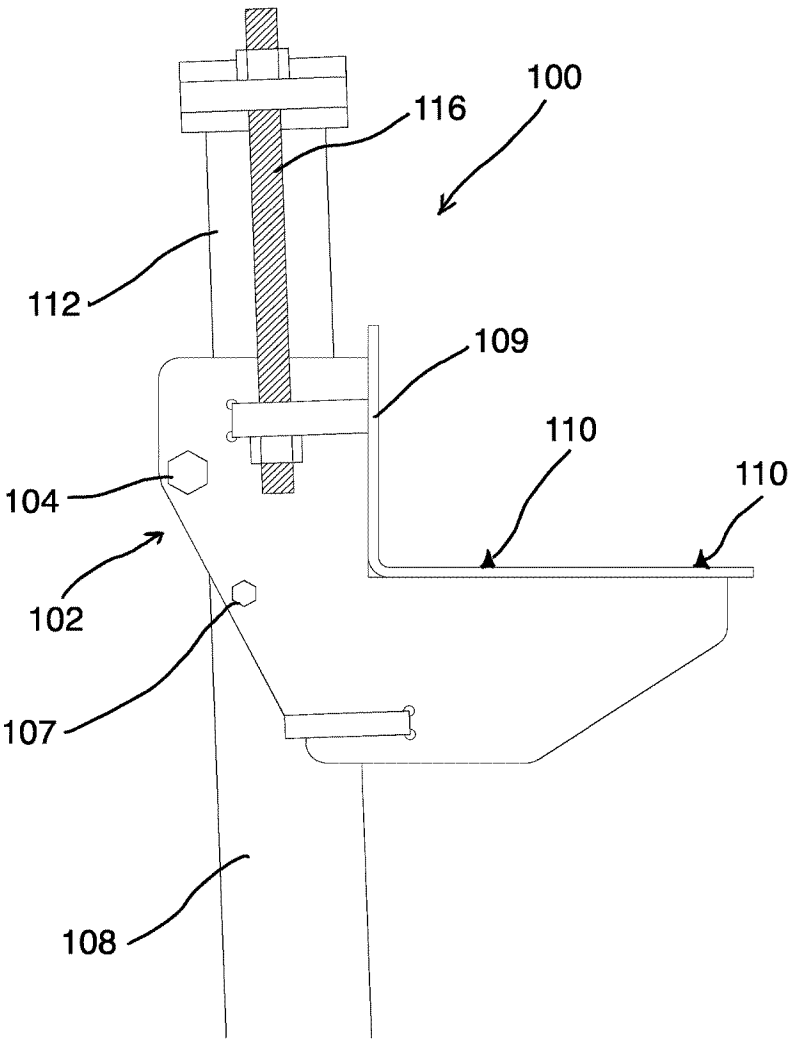
FIG. 7 is a side view of a foundation pier bracket system, in accordance with embodiments of the present invention.
Figure 6:
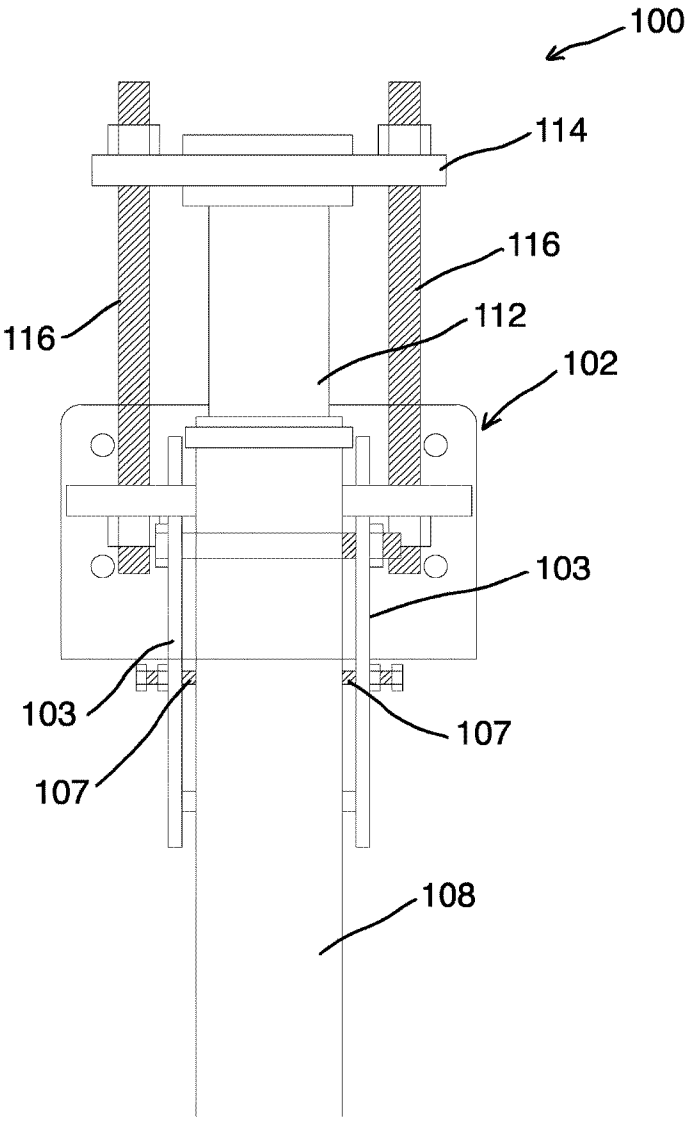
FIG. 6 is a front view of a foundation pier bracket system, in accordance with embodiments of the present invention.

Various other embodiments of the bracket system 100 are shown in FIGS. 6-10. In FIGS. 6-7, the system 100 can include a reinforcing sleeve set screw 107, or other like fasteners, devices, techniques, or elements to facilitate attachment, fixed or adjustable, of the bracket assembly 102 to the pier shaft 112 and the building structure.

Figure 9:
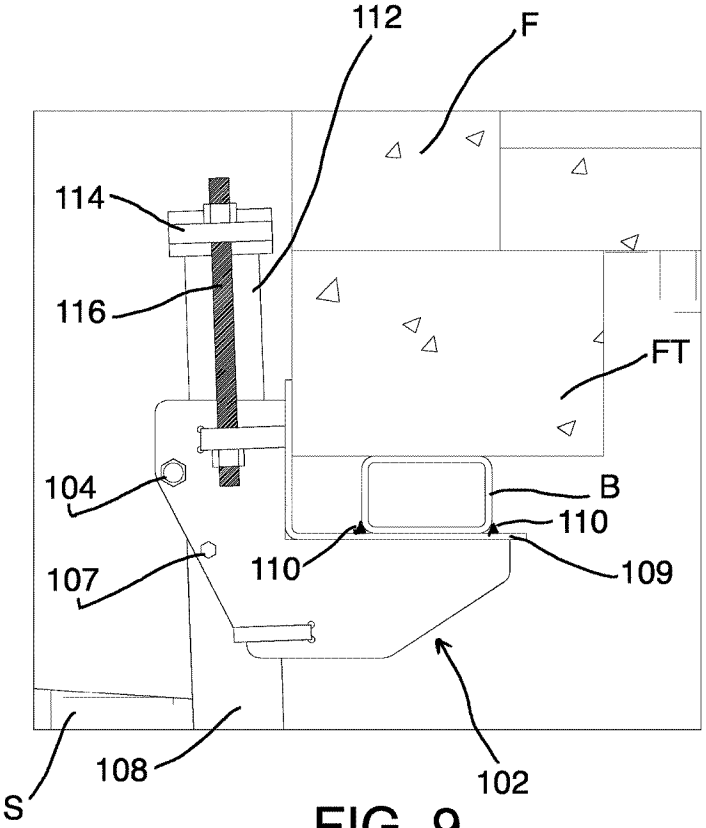
FIG. 9 is an enlarged view of a portion of FIG. 8.
Figure 8:
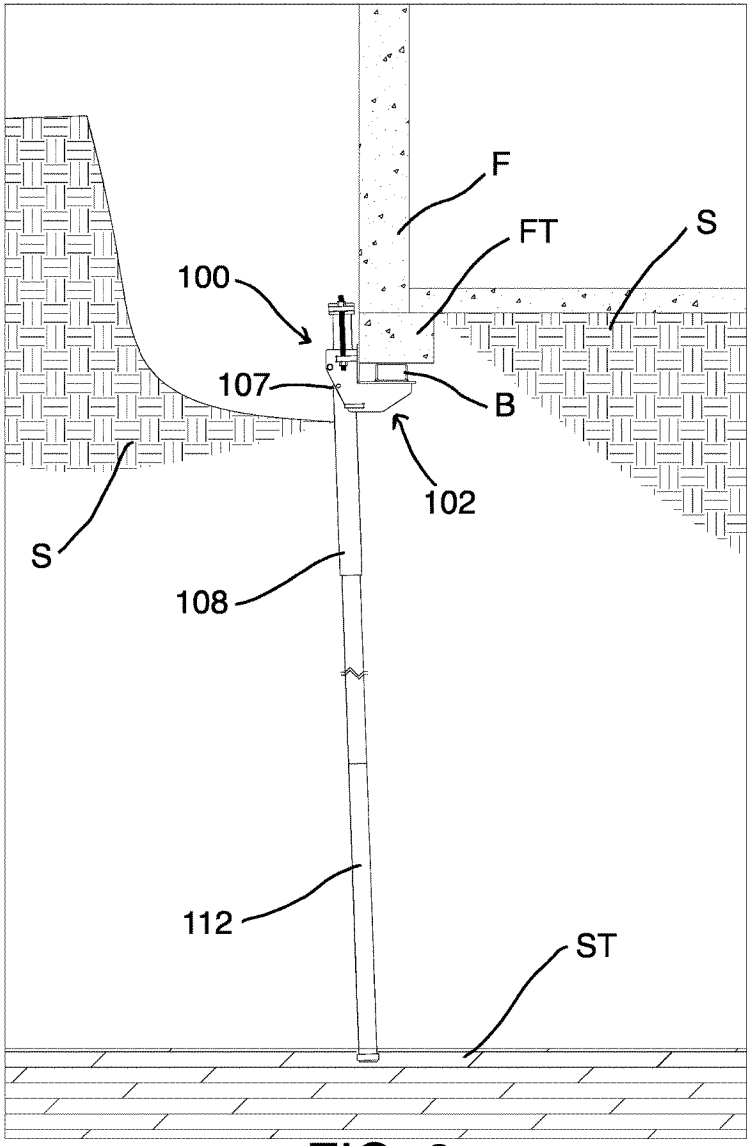
FIG. 8 shows a side cross-sectional view of a foundation pier bracket system in use to support a building structure, in accordance with embodiments of the present invention.
Figure 10:
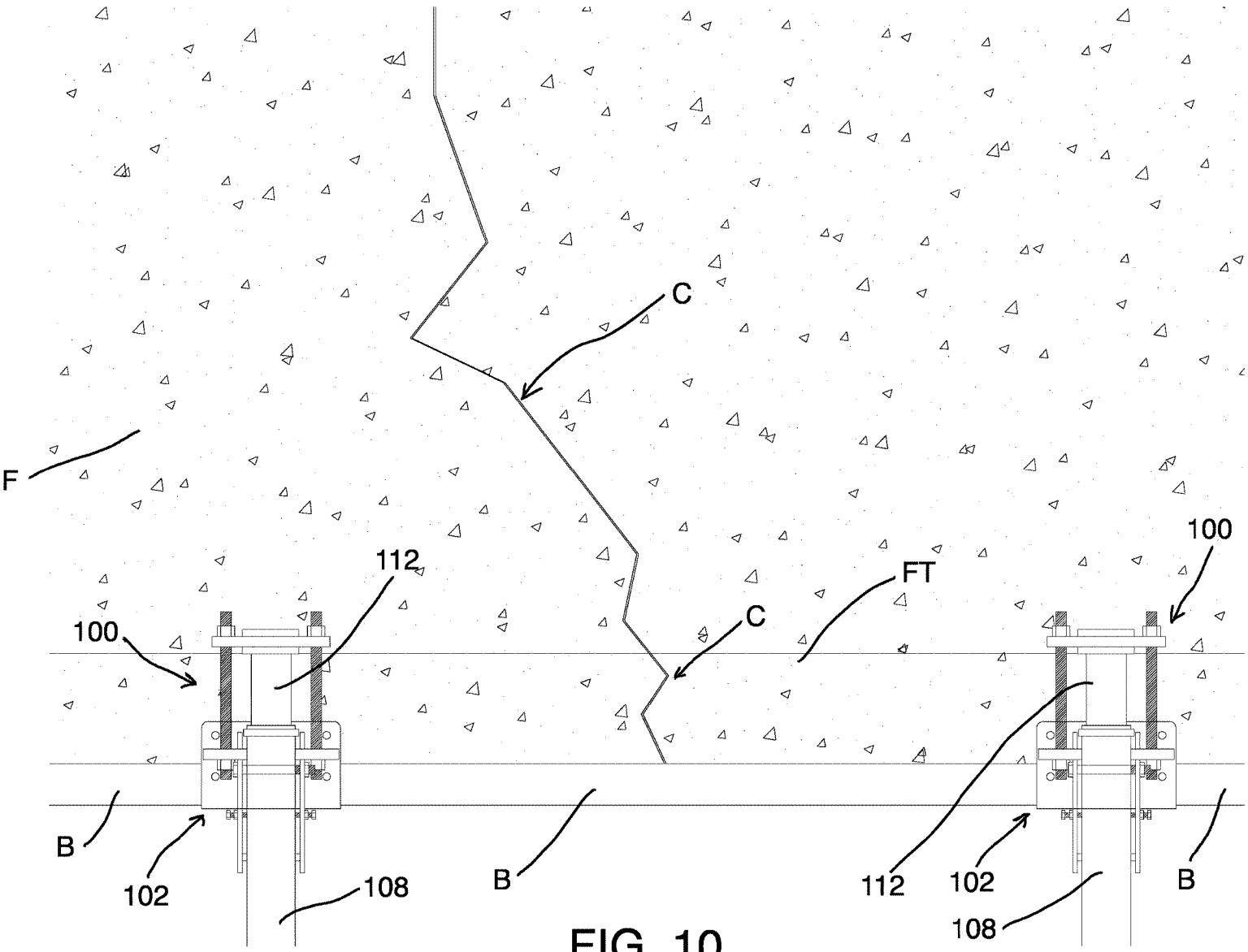
FIG. 10 shows a front cross-sectional view of a foundation pier bracket system in use to support a building structure, in accordance with embodiments of the present invention.
Figure 12:
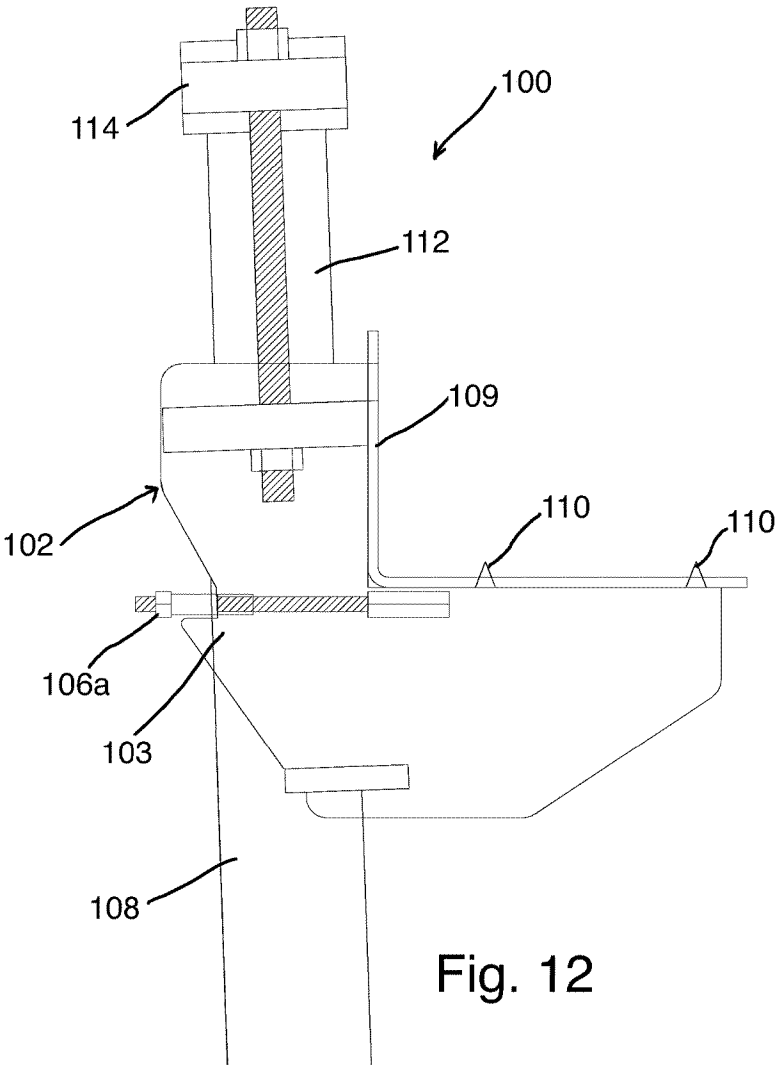
FIG. 12 is a side view of a foundation pier bracket system, in accordance with embodiments of the present invention.
Figure 11:
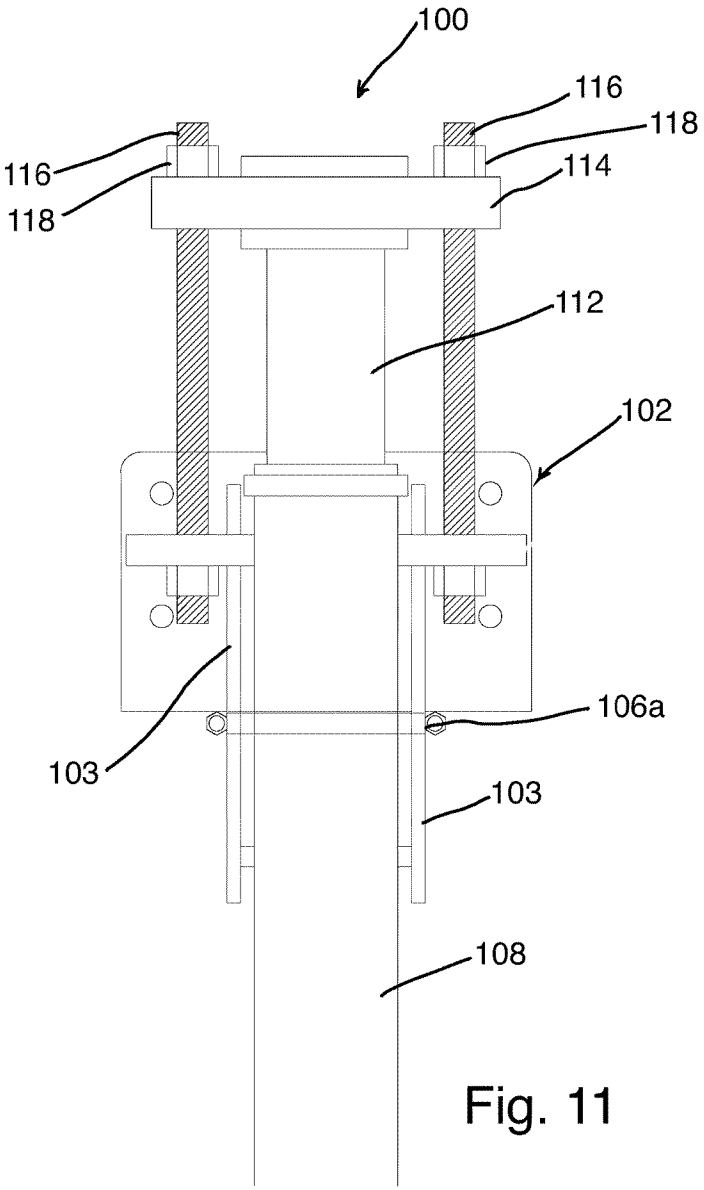
FIG. 11 is a front view of a foundation pier bracket system, in accordance with embodiments of the present invention.
Figure 14:
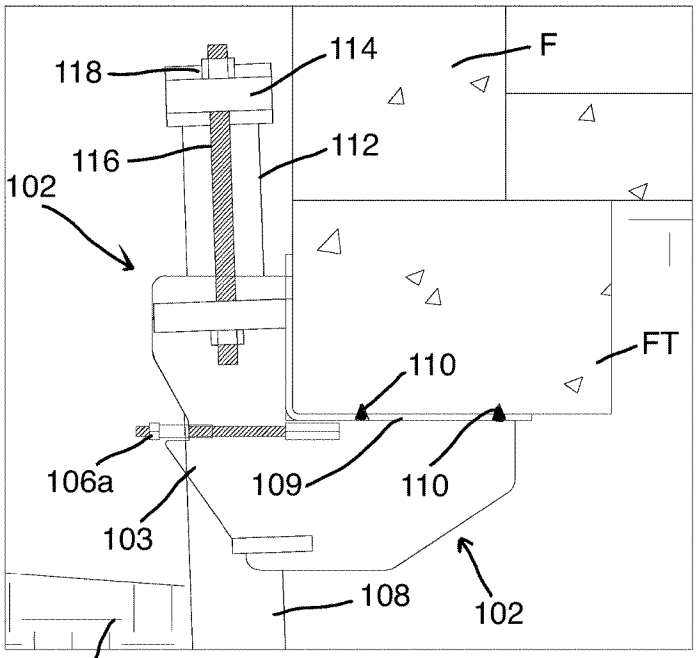
FIG. 14 is an enlarged view of a portion of FIG. 13.
Figure 13:
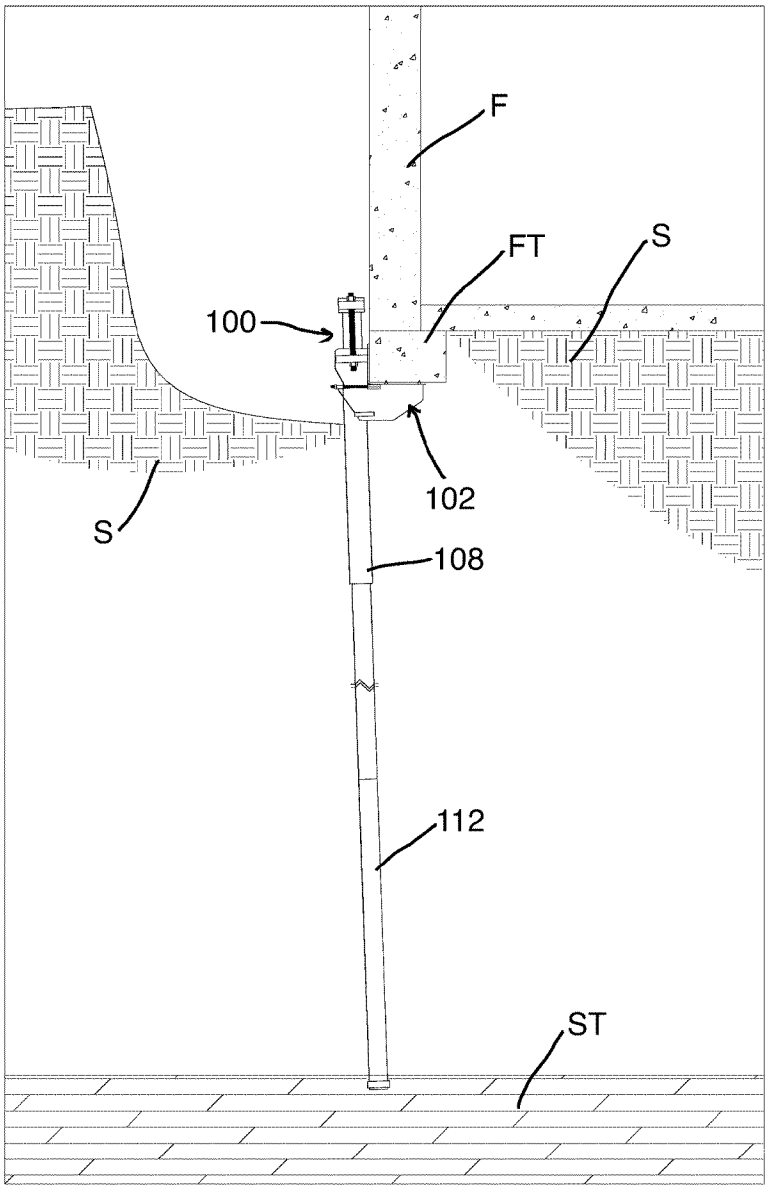
FIG. 13 shows a side cross-sectional view of a foundation pier bracket system in use to support a building structure, in accordance with embodiments of the present invention.
Figure 15:
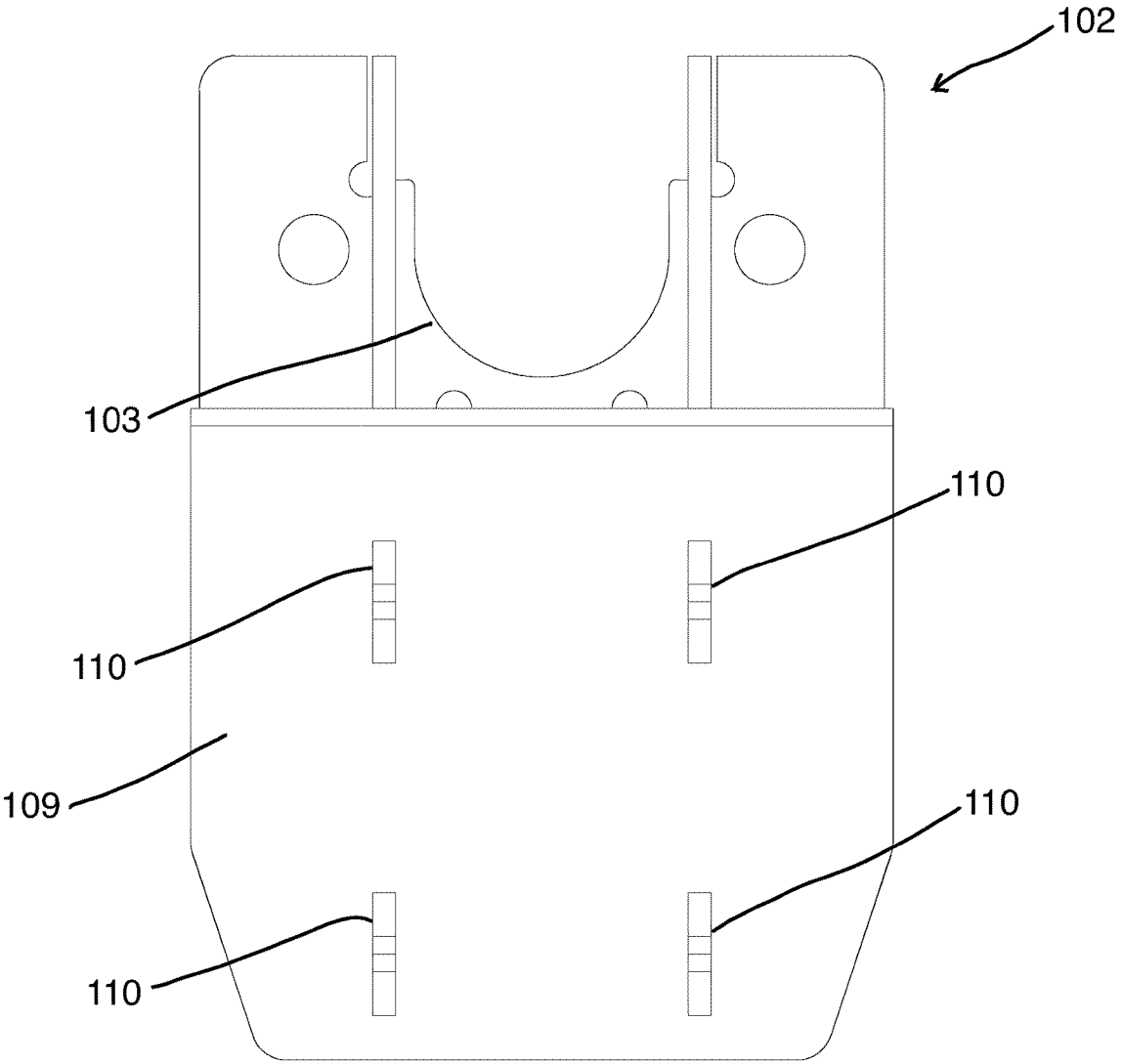
FIG. 15 is a top view of a foundation pier bracket, in accordance with embodiments of the present invention.

As shown in FIGS. 8-10, a steel beam member B (e.g. 3 inch by 5 inch box steel beam) used to span between two or more spaced-apart or adjacent bracket assemblies 102. This embodiment can be employed where there are structural defects, such as cracks C, in the building structure (e.g., the foundation F, the footings FT, walls, etc.). In such applications, the bracket assemblies 102 are generally not placed directly under the defect or crack but are, instead, positioned such that the crack C is intermediate adjacent brackets 102. The steel beam B then spans between the subject brackets 102 to provide support against and underneath the foundation F (or footing FT) and crack C (FIG. 10). Further, the teeth 110 are arranged on the seat portion 109 such that the beam B can be restrained in the lateral direction of the beam between the teeth 110 on the seat portion 109 to provide stability and securement for the beam B (FIG. 9). One or more beams B can be included with the bracket system 100, and the beams B can span between two or more bracket assemblies 102.

FIGS. 11-18 show an embodiment of the bracket system 100 wherein the sleeve clamp includes one or more set screws **106*a*. The one or more set screws 106*a* can extend into the receiving portion 103 of the bracket 102 to facilitate secure attachment into the reinforcing sleeve 108. Various other fasteners, bracket elements, mechanisms, devices, and the like can be included with, or in lieu of, the set screw 106*a* to promote the desired securement and stability for the system 100 during installation, use, and functioning support. The bracket system 100 facilitates improved attachment of the pier shaft 112 with the foundation F, and securement down to competent bearing strata ST to provide an open back pier bracket—e.g., FIGS. 13-14**.

Figure 17:
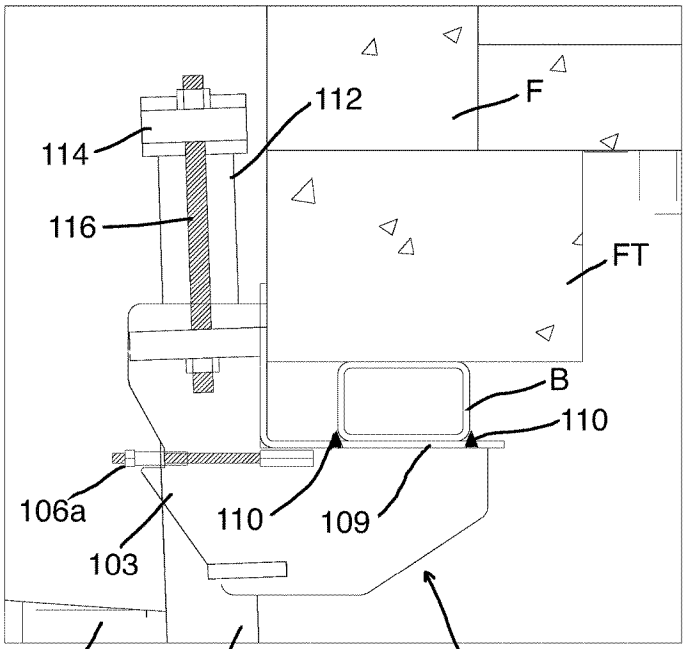
FIG. 17 is an enlarged view of a portion of FIG. 16.
Figure 16:
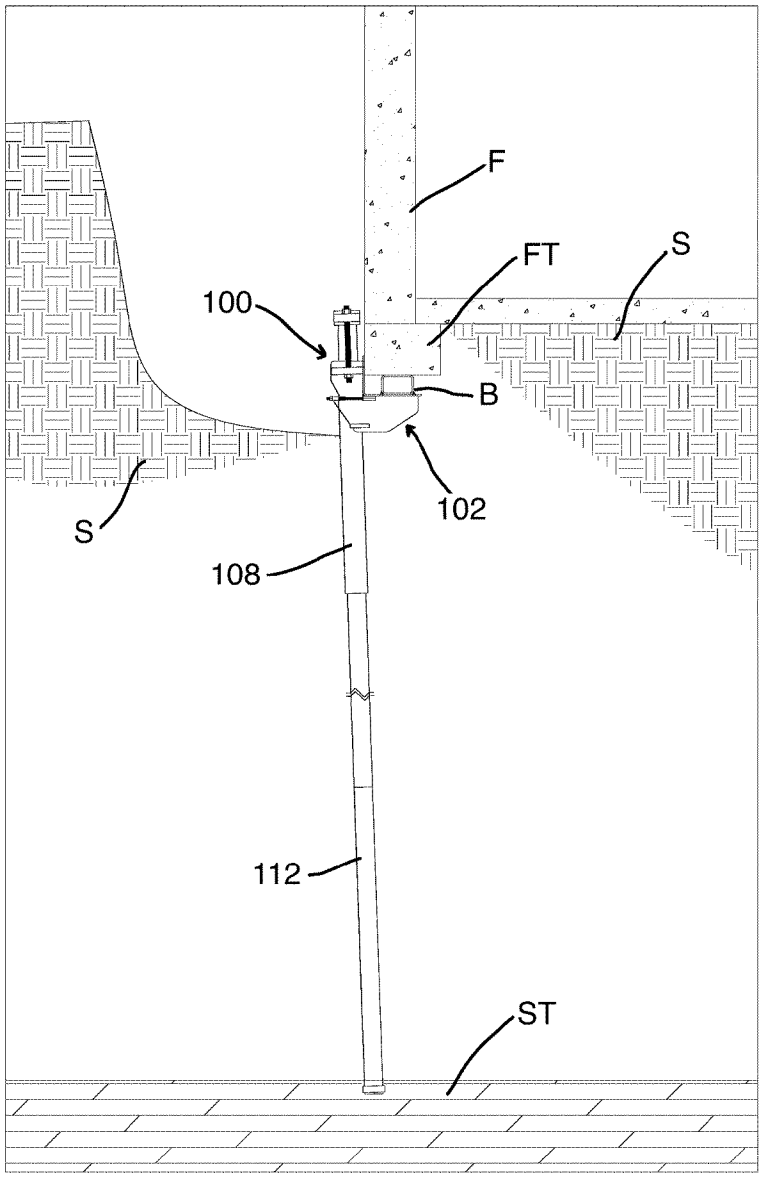
FIG. 16 shows a side cross-sectional view of a foundation pier bracket system in use to support a building structure, in accordance with embodiments of the present invention.
Figure 18:
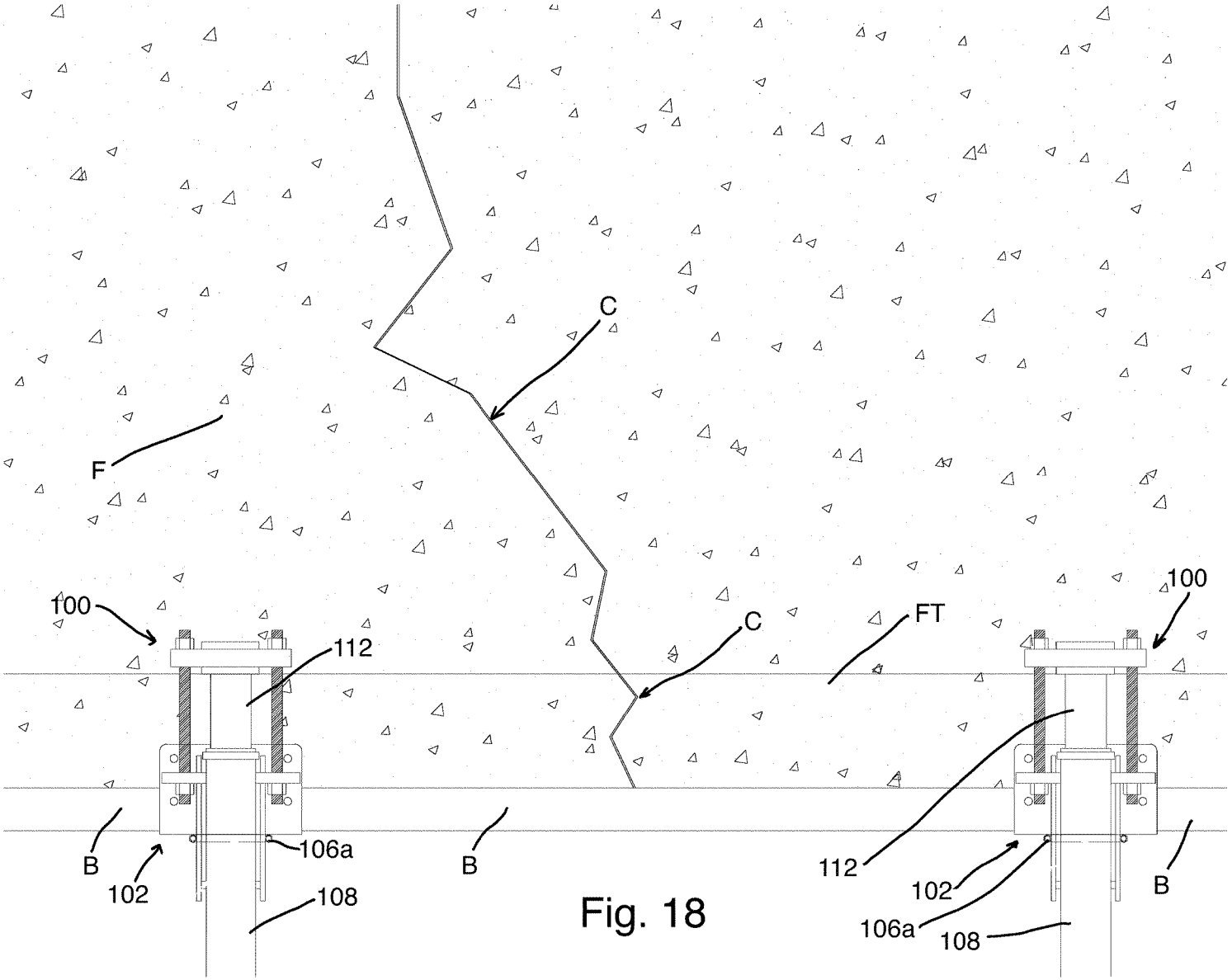
FIG. 18 shows a front cross-sectional view of a foundation pier bracket system in use to support a building structure, in accordance with embodiments of the present invention.
Figure 20:
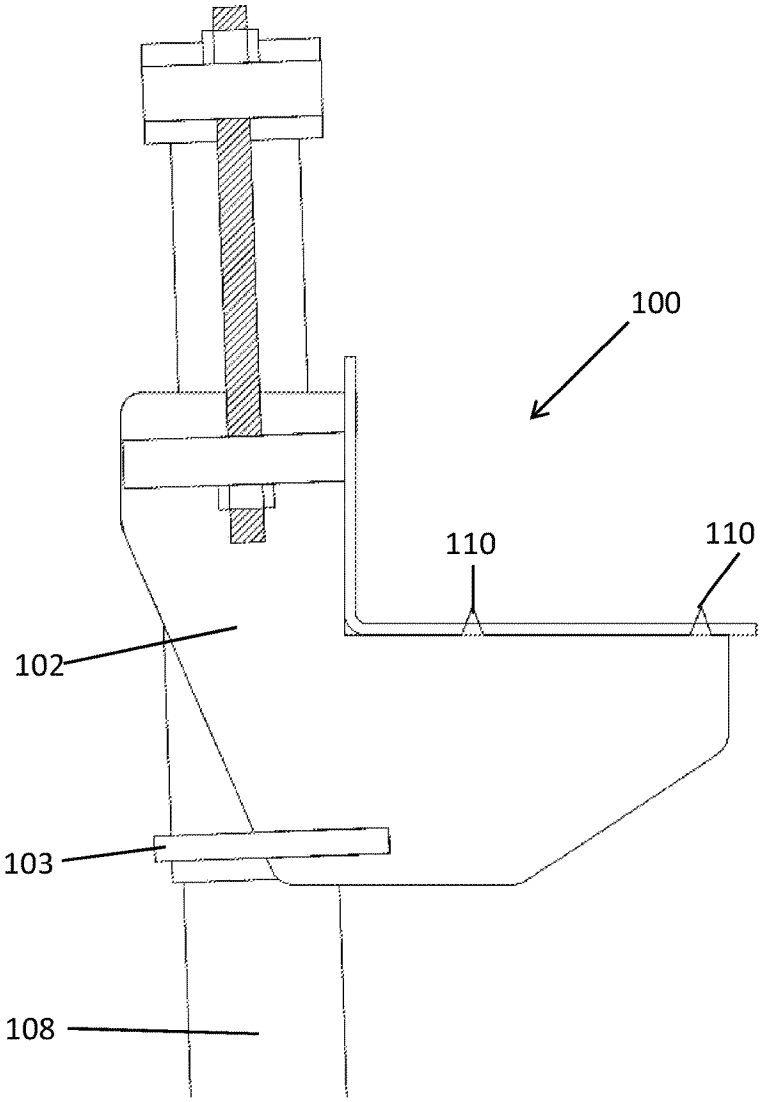
FIG. 20 is a side view of a foundation pier bracket system, in accordance with embodiments of the present invention.
Figure 19:
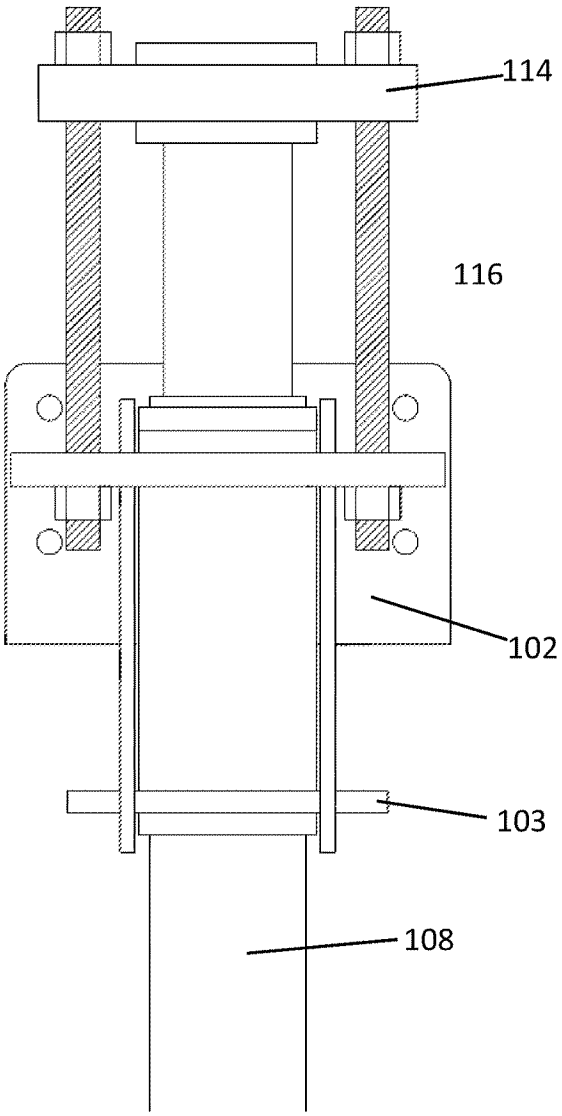
FIG. 19 is a front view of a foundation pier bracket system, in accordance with embodiments of the present invention.
Figure 22:
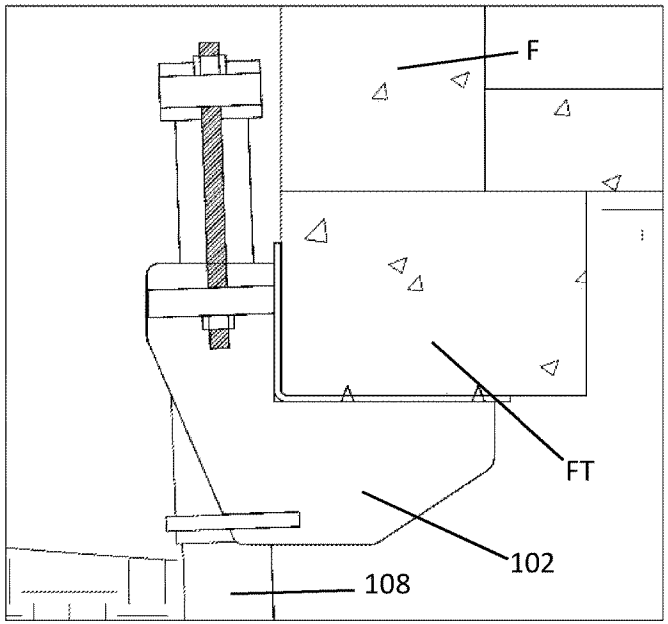
FIG. 22 is an enlarged view of a portion of FIG. 21.
Figure 21:
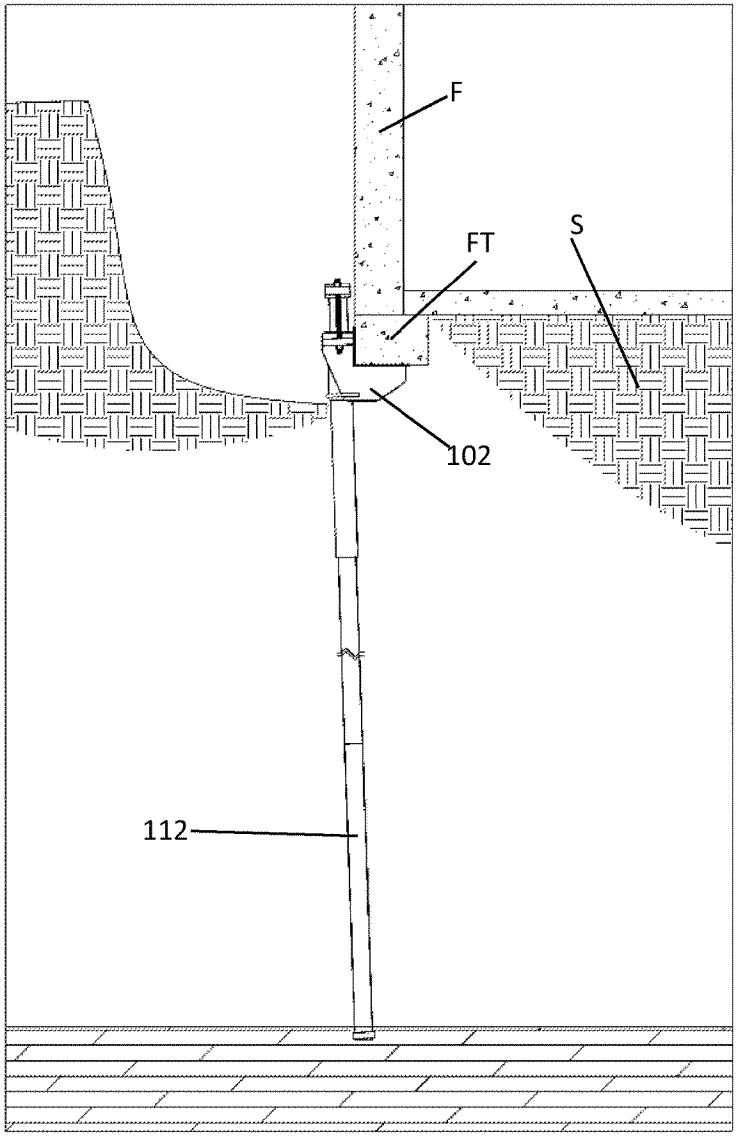
FIG. 21 shows a side cross-sectional view of a foundation pier bracket system in use to support a building structure, in accordance with embodiments of the present invention.

As shown in FIGS. 16-18, like other embodiments, the system 100 can be employed to address structural defects, such as cracks C, in the building structure—e.g., generally positioned such that the crack C is intermediate adjacent brackets 102. The beam B then spans between the subject brackets 102 to provide support.

FIGS. 19-28 show an embodiment of the bracket system 100 wherein the receiving portion 103 of the bracket assembly is fully-enclosed in the horizontal plane so that it surrounds an upper portion of the reinforcing sleeve 108. This strengthens the bracket assembly 102 and provides a means for locking the reinforcing sleeve 108 to the bracket assembly 102.

A problem with conventional pier brackets is during the installation process as the installer hydraulically advances the 36" pier sections into the ground, they have to release pressure to retract the hydraulic cylinder in order to add the next 36" pier tube. When retracting the cylinder the bracket falls and loses contact with the footing. This presents a safety and quality concern. The conventional solution is to put scrap lumber and shims between the soil and the bottom of the bracket in order to hold it in place. This is not only unreliable but very hard to do in mud and poor soil conditions.

Figure 25:
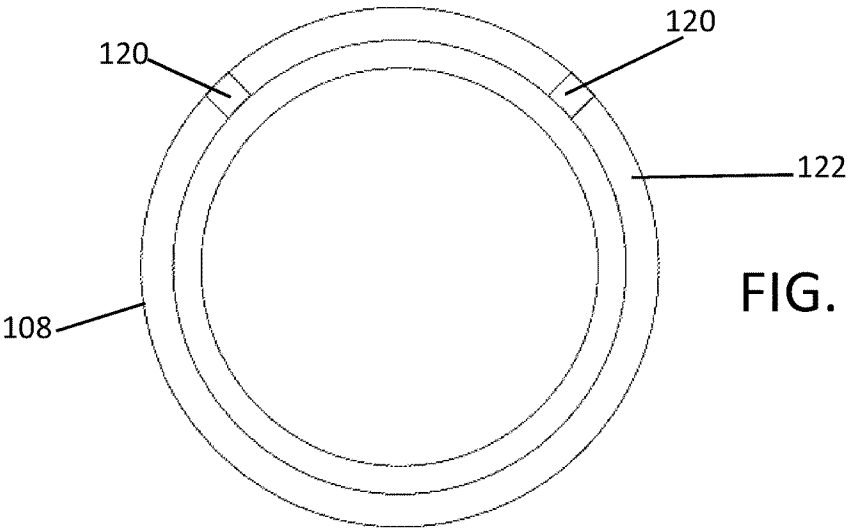
FIG. 25 is a top end view of a reinforcement sleeve, in accordance with embodiments of the present invention.
Figure 26:
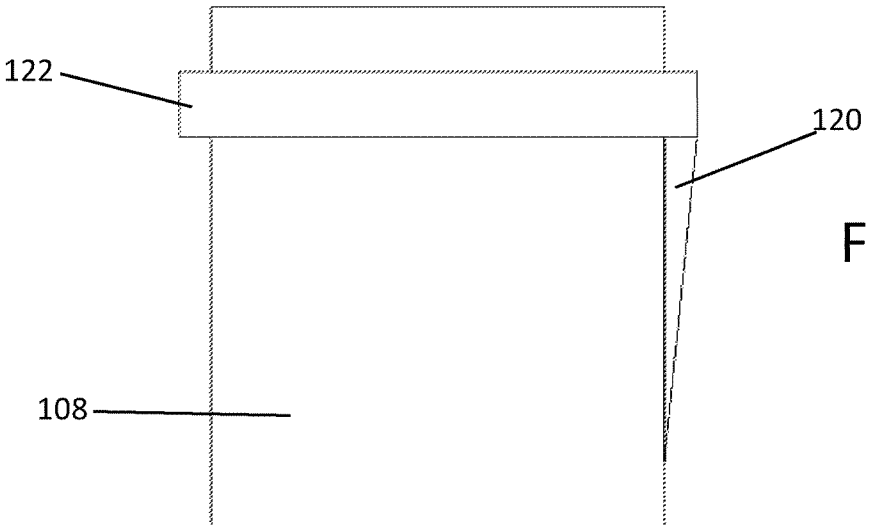
FIG. 26 is a side view of a top portion of a reinforcement sleeve, in accordance with embodiments of the present invention.
Figure 27:
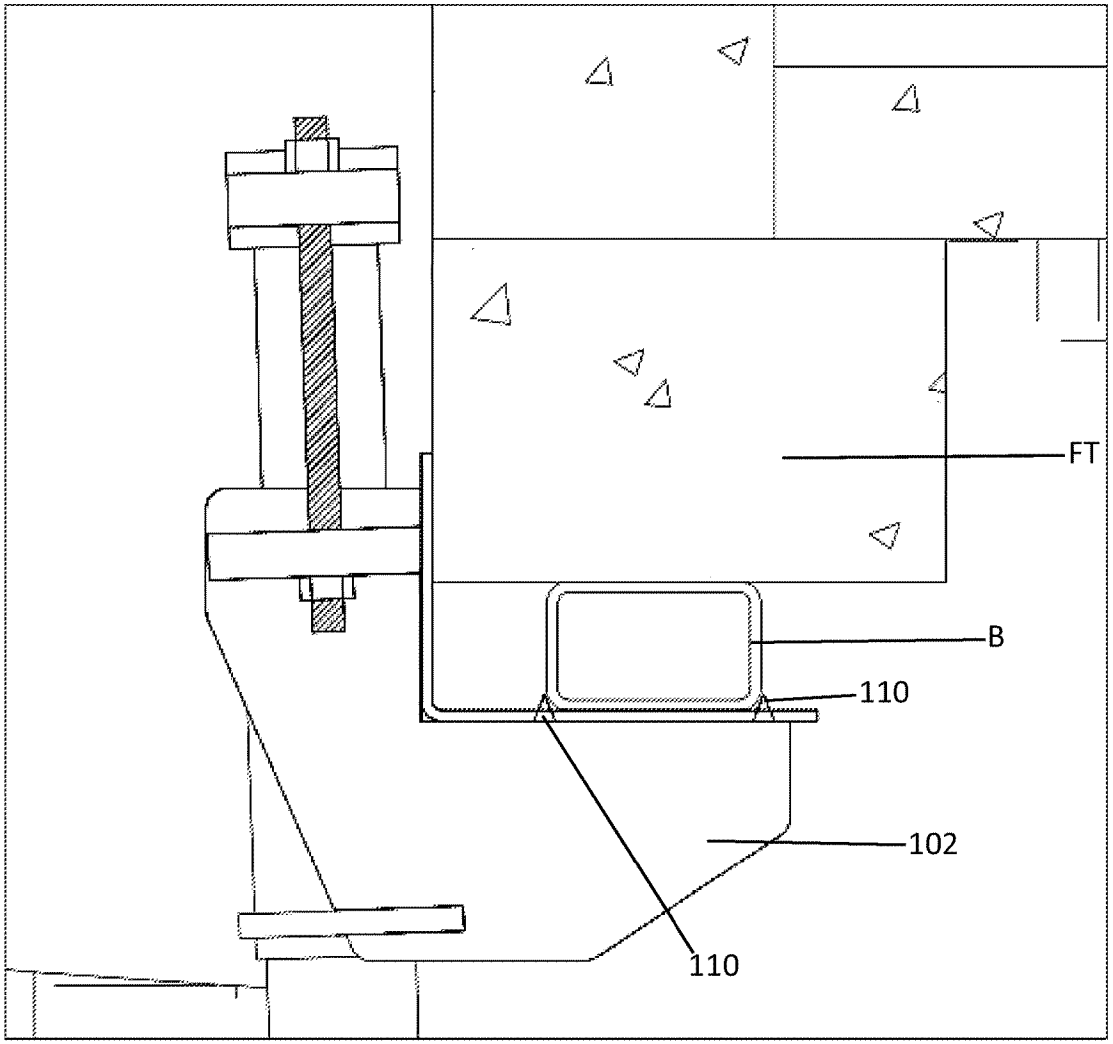
FIG. 27 shows a side cross-sectional view of a foundation pier bracket system in use to support a building structure, in accordance with embodiments of the present invention.
Figure 28:
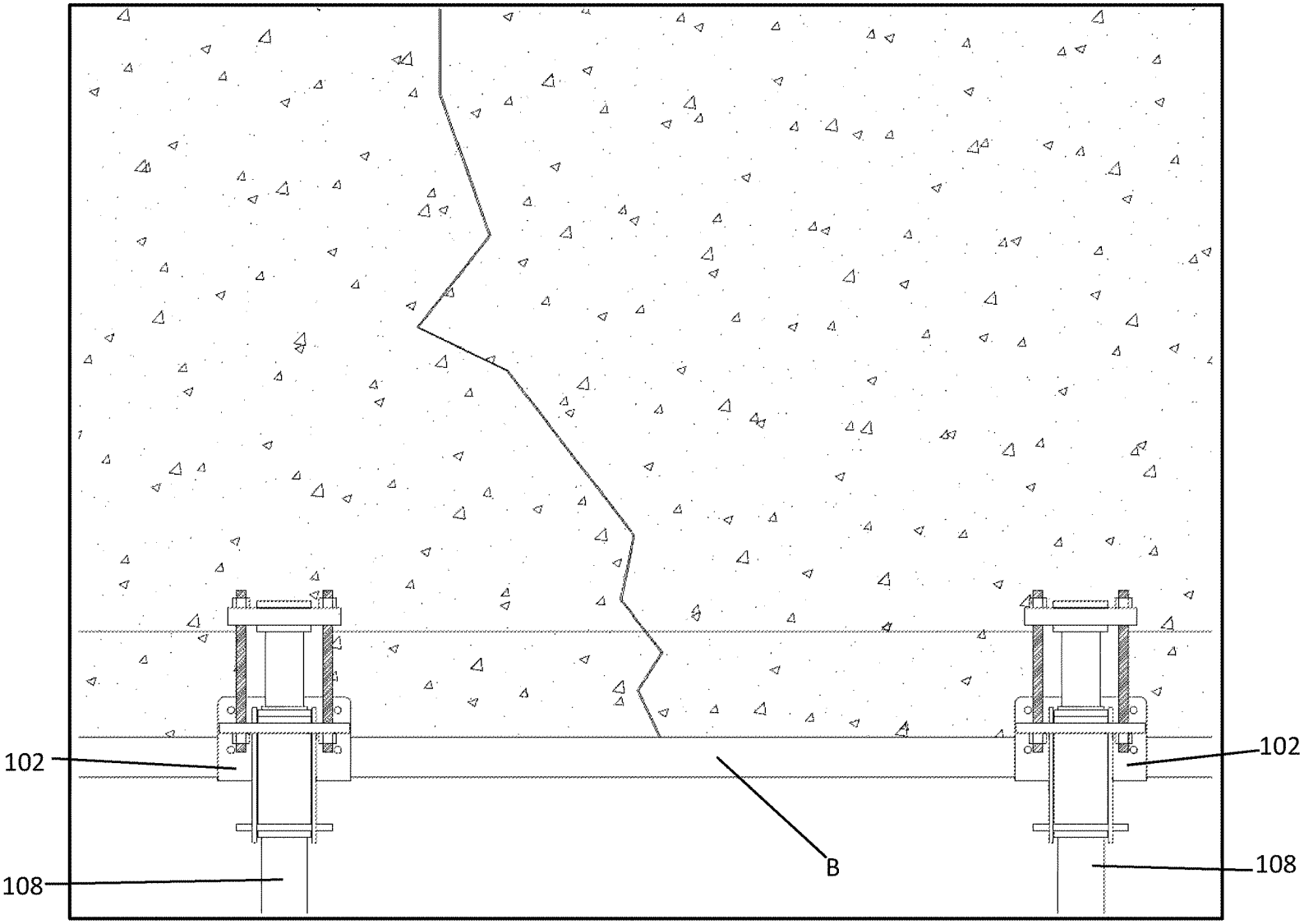
FIG. 28 shows a front cross-sectional view of a foundation pier bracket system in use to support a building structure, in accordance with embodiments of the present invention.

Instead the reinforcing sleeve 108 can be locked to the bracket 102 as the reinforcing sleeve 108 is installed into the bracket 102 using a steel locking wedge 120 that is hydraulically pressed into place while advancing the reinforcing sleeve 108 into place. As shown in FIGS. 25-26, an upper portion of the reinforcing sleeve 108 includes the locking wedge 120 that bites into the inner circumference of the receiving portion 103 so that the reinforcing sleeve 108 is held in place with respect to the bracket assembly 102 even when the installer releases pressure in the hydraulic cylinder to retract the cylinder to add the next segment of pier tube. This solution improves safety, quality and ease of installation.

The locking wedge 120 comprises a triangular piece of steel that spans from the top flange 122 of the reinforcing sleeve 108 in a distal direction longitudinally along the outer surface of the reinforcing sleeve 108. The locking wedge 120 tapers axially inward towards the outer surface of the reinforcing sleeve 108 as it travels distally until the locking wedge terminates 120.

More than one locking wedge can be provided. For example, two locking wedges are indicated in FIG. 25. However, three or more locking wedges can also be provided in alternative embodiments.

Figure 24:
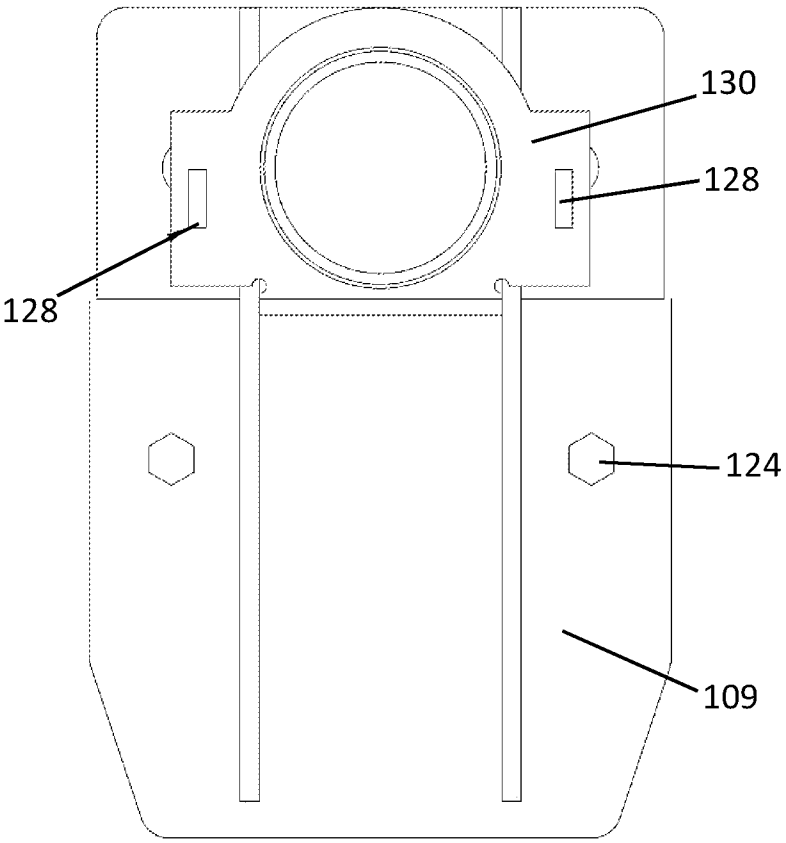
FIG. 24 is a bottom view of a foundation pier bracket, in accordance with embodiments of the present invention.
Figure 23:
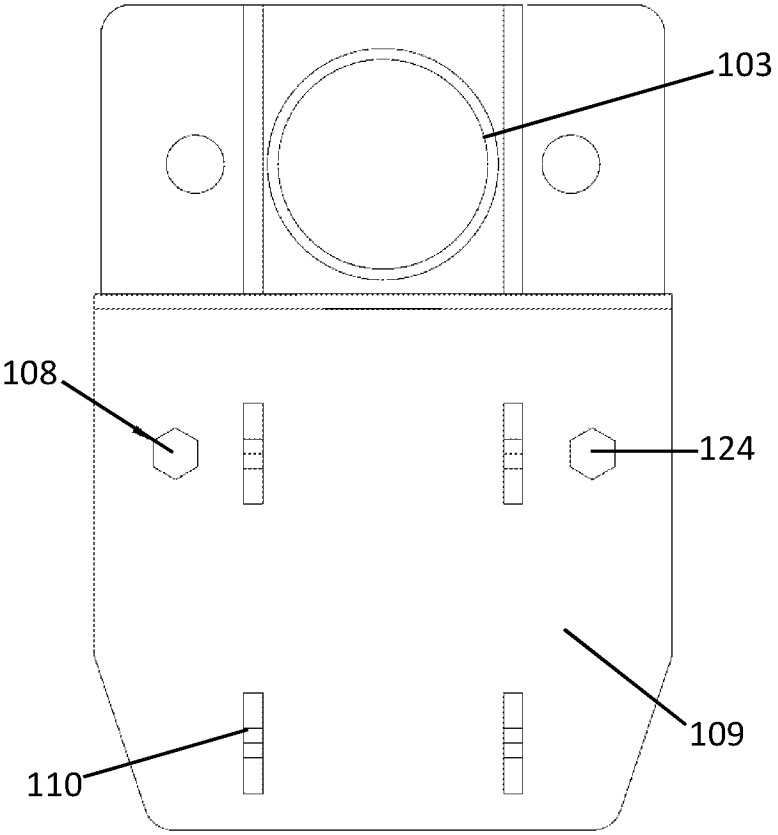
FIG. 23 is a top view of a foundation pier bracket, in accordance with embodiments of the present invention.
Figure 29:
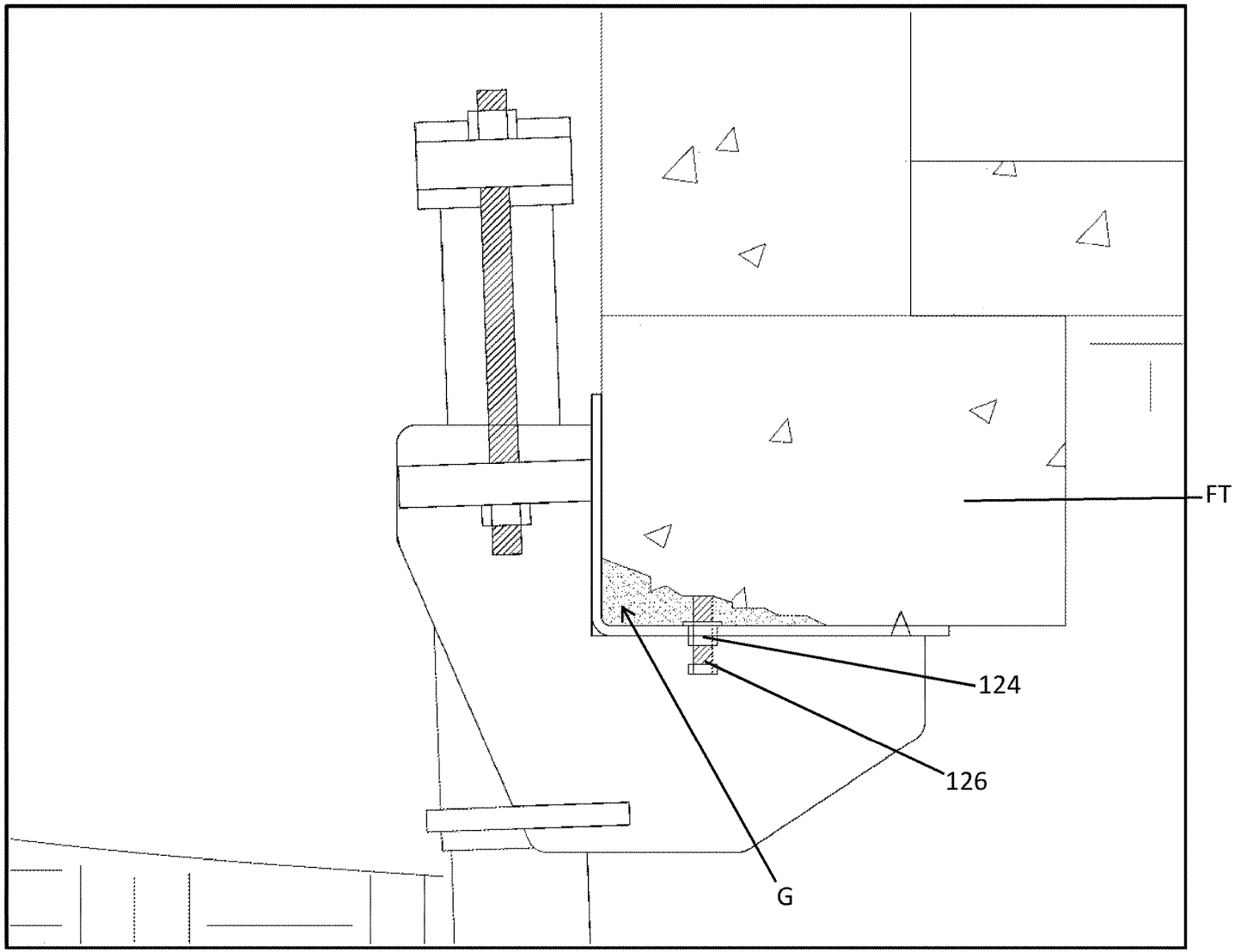
FIG. 29 shows a side cross-sectional view of a foundation pier bracket system in use to support a building structure, in accordance with embodiments of the present invention.

Referring now to FIGS. 23-24 and 29, a flange nut 124 is provided to the support portion 109 so that a bolt 126 can be threaded upward through the support portion 109 from the bottom side thereof. Sometimes the concrete footing FT is uneven or crooked such that a gap G exists between the support portion and the bottom surface of the footing. Threading the bolt 126 into the flange nut 124 allows the installer to adjust to the damaged or poorly prepped footing. The installer then fills the gap G with high strength concrete to further support the footing FT.

Referring to FIG. 24, the bracket assembly 102 can also include a plurality of bracket jack accommodation slots 128 defined through the jack support plate 130 provided to the bracket assembly 102 below the support plate 109.

Figure 30:
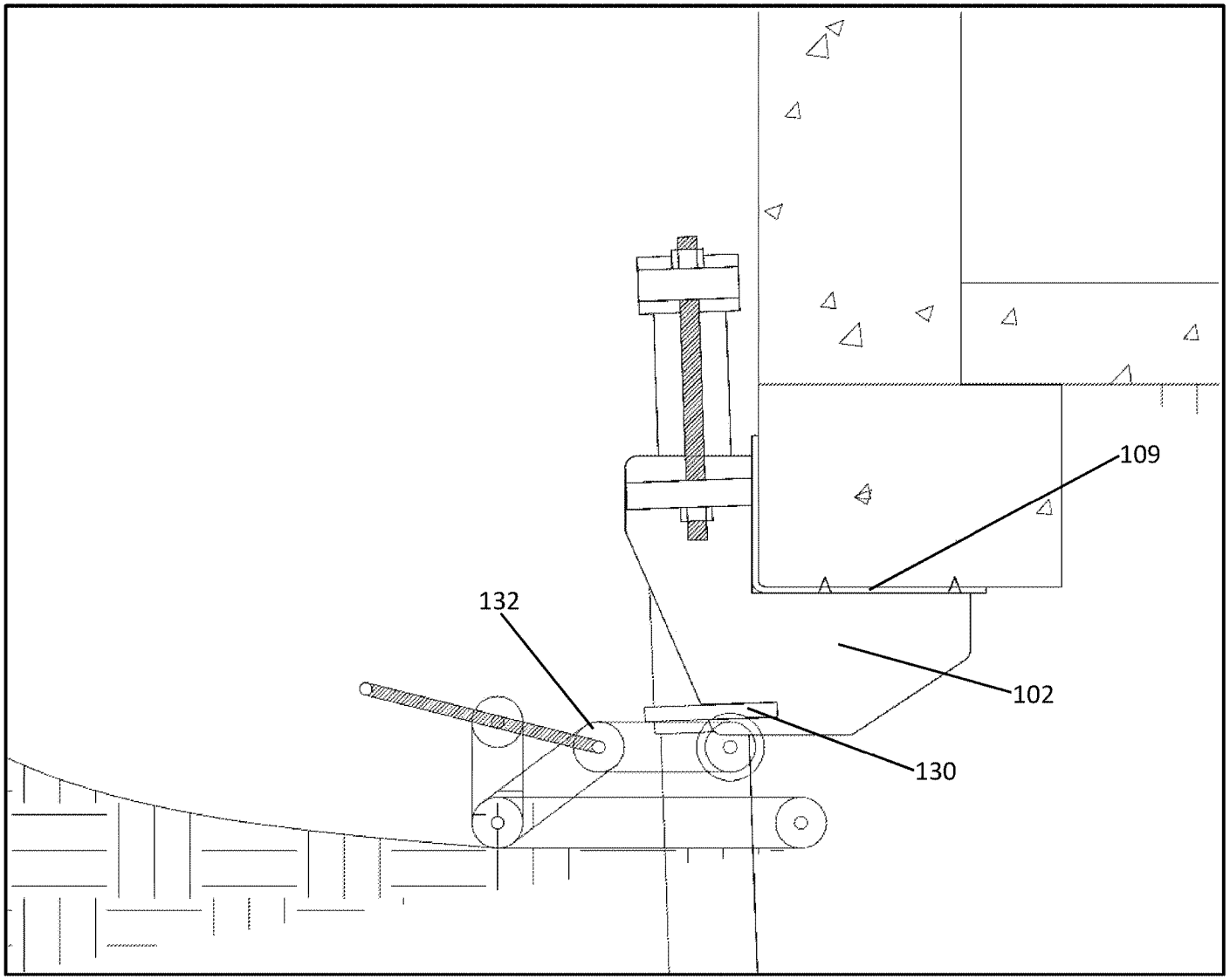
FIG. 30 shows a side cross-sectional view of a foundation pier bracket system and bracket jack in use to support a building structure, in accordance with embodiments of the present invention.

As can be seen in FIG. 30, a bracket jack 132 can be provided and engaged with the accommodation slots 128 defined through a jack support plate 130 of the shaft receiving portion 103 of the bracket assembly 102. The bracket jack 132 is a mechanical linkage configured to raise the bracket assembly 102 to seat it properly and firmly before adding the hydraulic ram and before installing the reinforcing sleeve lock and pier tubes. The jack 132 rests on the ground and an adjustable upper portion engages the jack support plate 130. The accommodation slots 128 and jack 130 add to the ease and quality of the installation of the push pier.

While the invention has been described in connection with what is presently considered to be the most practical and preferred example embodiments, it will be apparent to those of ordinary skill in the art that the invention is not to be limited to the disclosed example embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A foundation reinforcement system, comprising:

an elongated beam;

a first bracket assembly, the first bracket assembly comprising a shaft receiving portion and a seat portion, wherein the seat portion includes a plurality of protruding members that protrude upwardly therefrom; and a second bracket assembly, the second bracket assembly comprising a shaft receiving portion and a seat portion, wherein the seat portion includes a plurality of protruding members that protrude upwardly therefrom, wherein the elongated beam is disposed atop the seat portion of the first bracket assembly such that at least one of the plurality of protruding members of the first bracket assembly is disposed on each of opposing lateral sides of the elongated beam, wherein the second bracket assembly is horizontally spaced-apart from the first bracket assembly, and wherein the elongated beam is disposed atop the seat portion of the second bracket assembly such that at least one of the plurality of protruding members of the second bracket assembly is disposed on each of opposing lateral sides of the elongated beam.

2. The foundation reinforcement system of claim 1, wherein the plurality of protruding members of each of the first bracket assembly and the second bracket assembly are inwardly offset from outer edges of the respective seat portions.

3. The foundation reinforcement system of claim 1, wherein the plurality of protruding members of each of the first bracket assembly and the second bracket assembly are arranged to allow for longitudinal movement of the elongated beam across the respective seat portions while preventing lateral movement of the elongated beam across the respective seat portions.

4. The foundation reinforcement system of claim 1, wherein the seat portion is planar.

5. The foundation reinforcement system of claim 1, wherein the plurality of protruding members of each of the first bracket assembly and the second bracket assembly are each triangular and are arranged such that a single point thereof points vertically upward from the seat portion.

6. The foundation reinforcement system of claim 1, wherein the plurality of protruding members of each of the first bracket assembly and the second bracket assembly are each elongated in top plan view and aligned with the longitudinal axis of the elongated beam.

7. The foundation reinforcement system of claim 1, wherein the first bracket assembly further comprises a jack support plate.

8. The foundation reinforcement system of claim 7, wherein the jack support plate includes a plurality of bracket jack accommodation slots defined vertically therethrough.

9. The foundation reinforcement system of claim 1, wherein the seat portion of each of the first bracket assembly and the second bracket assembly further includes a flange nut secured thereto and arranged such that a bolt threaded into the flange nut from below the seat portion can protrude through the seat portion and extend vertically above the seat portion.

10. The foundation reinforcement system of claim 1, wherein the plurality of protruding members of each of the first bracket assembly and the second bracket assembly are each arranged in two rows with each row having two columns such that the beam can be restrained between the adjacent rows.

11. The foundation reinforcement system of claim 1, further comprising a bracket jack engageable with the first bracket assembly.

12. The foundation reinforcement system of claim 1, wherein the elongated beam is a box steel beam.

* * * * *